US009359163B1

(12) United States Patent
Miyazaki et al.

(10) Patent No.: US 9,359,163 B1
(45) Date of Patent: Jun. 7, 2016

(54) SHEET PROCESSING APPARATUS AND IMAGE FORMING APPARATUS

(71) Applicant: KYOCERA Document Solutions Inc., Osaka (JP)

(72) Inventors: Masahiko Miyazaki, Osaka (JP); Yasunori Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/907,988

(22) PCT Filed: Jan. 20, 2015

(86) PCT No.: PCT/JP2015/051384
§ 371 (c)(1),
(2) Date: Jan. 27, 2016

(87) PCT Pub. No.: WO2015/141265
PCT Pub. Date: Sep. 24, 2015

(30) Foreign Application Priority Data

Mar. 17, 2014 (JP) ..... 2014-053496

(51) Int. Cl.
*B65H 31/26* (2006.01)
*B65H 31/30* (2006.01)
(Continued)

(52) U.S. Cl.
CPC ..... *B65H 31/26* (2013.01); *B65H 29/20* (2013.01); *B65H 29/22* (2013.01);
(Continued)

(58) Field of Classification Search
CPC ..... B65H 29/00; B65H 29/20; B65H 29/22; B65H 31/00; B65H 31/26; B65H 31/34; B65H 31/38; B65H 2404/70; B65H 2404/722; B65H 2404/725; B65H 2404/1521; B65H 2301/5212; B65H 2301/4222
See application file for complete search history.

(56) References Cited

U.S. PATENT DOCUMENTS

2004/0201165 A1* 10/2004 Kamiya ..... B65H 31/26 271/220
2011/0006476 A1* 1/2011 Morita ..... B65H 31/3027 271/265.04

(Continued)

FOREIGN PATENT DOCUMENTS

JP 2000-169031 A 6/2000
JP 2006-273561 A 10/2006

(Continued)

OTHER PUBLICATIONS

International Search Report—PCT/JP2015/051384 mailed Apr. 14, 2015.

*Primary Examiner* — Prasad Gokhale
(74) *Attorney, Agent, or Firm* — Studebaker & Brackett PC

(57) ABSTRACT

A sheet processing apparatus (3) includes a pressing lever (46) turnable between a first position where the pressing lever (46) abuts with the sheet bundle on a stacking tray (34) and a second position where the pressing lever (46) is displaced on a side of a discharging part (44) side from the first position. The discharging part (44) has an upper roller (56) and a lower roller (57). The lower roller (57) abuts with a lowermost sheet of the sheet bundle and an upper roller (56) is configured to separate upward from the lower roller (57) during the shifting and to be displaced in a direction approaching the lower roller (57) during the discharging. The pressing lever (46) is configured to project upward from above an apex portion of the lower roller (57) at the second position and to turn into the second position during the shifting.

7 Claims, 8 Drawing Sheets

(51) Int. Cl.

| | |
|---|---|
| ***B65H 37/04*** | (2006.01) |
| ***B65H 31/38*** | (2006.01) |
| ***B65H 29/20*** | (2006.01) |
| ***B65H 29/22*** | (2006.01) |
| ***B65H 31/34*** | (2006.01) |

(52) U.S. Cl.

CPC ..... *B65H 31/3081* (2013.01); *B65H 31/34* (2013.01); *B65H 31/38* (2013.01); *B65H 37/04* (2013.01); *B65H 2301/4212* (2013.01); *B65H 2301/4222* (2013.01); *B65H 2301/4223* (2013.01); *B65H 2301/42266* (2013.01); *B65H 2404/1521* (2013.01); *B65H 2404/70* (2013.01); *B65H 2701/18292* (2013.01); *B65H 2801/27* (2013.01)

(56) References Cited

U.S. PATENT DOCUMENTS

| | | | | |
|---|---|---|---|---|
| 2012/0223470 | A1* | 9/2012 | Soga ..... | B65H 31/02 270/58.12 |
| 2013/0341856 | A1* | 12/2013 | Takemasa ..... | B65H 29/00 271/220 |
| 2014/0061991 | A1* | 3/2014 | Shimura ..... | B65H 29/14 270/1.01 |

FOREIGN PATENT DOCUMENTS

| | | | |
|---|---|---|---|
| JP | 2010-195494 | A | 9/2010 |
| JP | 2013-079144 | A | 5/2013 |
| JP | 2013-245070 | A | 12/2013 |

* cited by examiner

SHEET PROCESSING APPARATUS AND IMAGE FORMING APPARATUS

TECHNICAL FIELD

The present invention relates to a sheet processing apparatus applying a post-processing on a sheet and to an image forming apparatus provided with the sheet processing apparatus.

BACKGROUND

Conventionally, there is known a sheet processing apparatus in which a plurality of sheets conveyed from an image forming apparatus, such as a copying machine, a multi-function peripheral or the like, are loaded up on a processing tray into a sheet bundle and then a post-processing, such as stapling and sorting, is applied on the sheet bundle. Such a sheet processing apparatus is configured to shift the sheet bundle on the processing tray in a width direction orthogonal to the sheet conveying direction so as to position the sheet bundle at a stapling position or to sort the sheet bundle. The processed sheet bundle is discharged on a stacking tray by a discharge part composed of an upper and lower roller pair.

In such a sheet processing apparatus, while the processed sheet bundle is stacked on the stacking tray, a previously discharged sheet bundle may be pushed by a leading end of a newly discharged sheet bundle and then be dislocated on the stacking tray or drop from the stacking tray.

As a countermeasure on this problem, Patent Document 1 discloses a sheet processing apparatus including a pressing member pressing a rear end of the discharged sheet bundle on the stacking tray.

PRIOR ART DOCUMENT

Patent Document

[Patent Document 1] Japanese Patent Application Laid-open No. 2006-273561

SUMMARY OF INVENTION

Problems to be Solved by the Invention

By the way, there is a case where the sheet processing apparatus of the type described in Patent Document 1 is constructed such that a leading end portion of a sheet conveyed onto the processing tray reaches the stacking tray over the discharge part in consideration of downsizing of the sheet processing apparatus. In this case, when the sheet bundle is shifted on the processing tray for the post-processing, a lower face of the sheet bundle comes into contact with the lower roller of the discharge part. If the lower roller is made of rubber, the sheet may be dislocated due to a friction with the lower roller, causing misalignment on the processing tray.

Therefore, there is a case where a projection or a spring lifting the sheet bundle is disposed in the vicinity of the lower roller so that the sheet bundle does not come in contact with the lower roller. However, if the sheet bundle is lifted by the projection or the spring, when the upper and lower rollers approach with each other to discharge the processed sheet bundle from the processing tray, the upper roller does not come into contact with the lower roller, causing discharge failure. Still further, a strong force is required in order to bring the upper and lower rollers come into contact each other while lifting the sheet bundle from the lower roller. Alternatively, although there is a configuration where the sheet bundle is lifted together with the processing tray, such a configuration increases size and cost.

The present invention has been made in view of the circumstance described above, and it is an object of the present invention to provide a sheet processing apparatus enabling to shift a sheet bundle while keeping an aligned state on the processing tray without increasing complexity of the configuration and a number of components and also without causing an damage on the discharging operation in the discharge part and an image forming apparatus provided with the sheet processing apparatus.

Means of Solving the Problems

A sheet processing apparatus according to the present invention applying a post-processing on a conveyed sheet comprises: a processing tray on which a plurality of sheet are loaded into a sheet bundle; a shifting unit configured to shift the sheet bundle in a width direction intersecting with a conveying direction of the sheet on the processing tray; a discharging part configured to discharge the sheet bundle from the processing tray; a stacking tray on which the sheet bundle discharged by the discharging part is stacked; and a pressing lever turnable between a first position where the pressing lever abuts with the sheet bundle on the stacking tray and a second position where the pressing lever is displaced on the discharging part side from the first position; wherein the discharging part includes a lower roller abutting with a lowermost sheet of the sheet bundle and an upper roller configured to separate upward from the lower roller during the shifting and to be displaced in a direction approaching the lower roller during the discharging of the sheet bundle; and the pressing lever is configured to project upward from above an apex portion of the lower roller at the second position and to turn into the second position during the shifting.

By employing such a configuration, it becomes possible to prevent the dislocation of the sheet because the contact of the lower roller of the discharge part with the sheet can be reduced when the sheet is shifted on the processing tray. Still further, it is possible to prevent an addition of new components as much as possible because the conventionally existing pressing lever is used.

THE MODE FOR CARRYING OUT THE INVENTION

Hereinafter, with reference to figures, an image forming apparatus and a sheet processing apparatus according to an embodiment of the present invention will be described.

Figure 1:
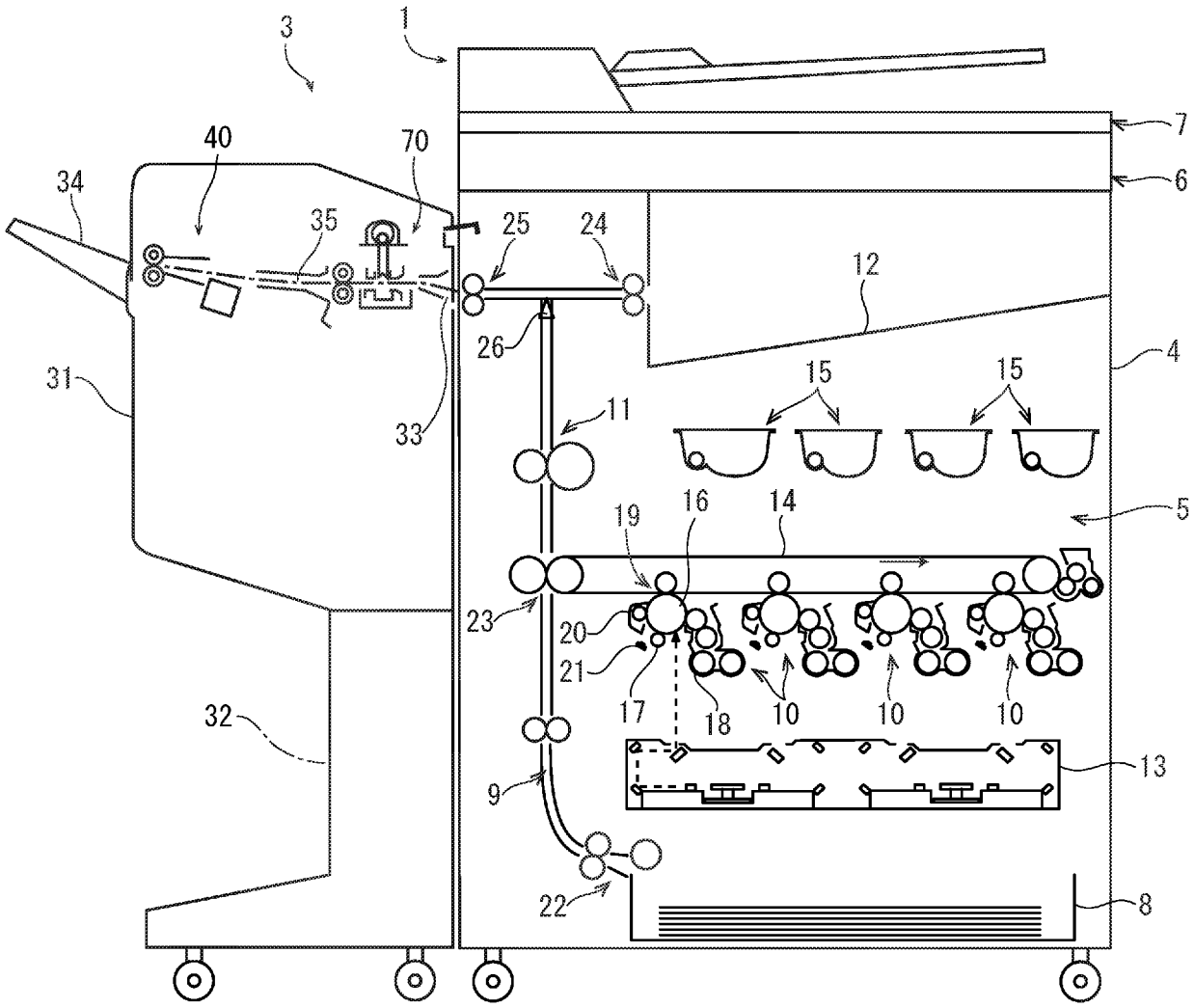
FIG. 1 is a front view schematically showing a configuration of a sheet processing apparatus and an image forming apparatus according to one embodiment of the present invention.

First, with reference to FIG. 1, an entire configuration of the image forming apparatus 1 and the sheet processing apparatus 3 according to the embodiment of the present invention will be described. FIG. 1 is a front view schematically showing the image forming apparatus 1 and the sheet processing apparatus 3 according to one embodiment of the present invention. In the following description, a front side in FIG. 1 shows a front side of the image forming apparatus and the sheet processing apparatus 3, and left and right directions are based a direction in which the image forming apparatus 1 is viewed from the front side.

The image forming apparatus 1 includes a box-like formed housing 4. In the housing 4, an image forming unit 5, an image reading unit 6 configured to read an image on a document and the like are stored. On the upper face of the housing 4, an automatically document feeding apparatus 7 (ADF) configured to automatically feed a document one by one to the image reading unit 6 is provided.

The image forming unit 5 is configured to perform an image forming processing based on image data transmitted from a personal computer or the image reading unit 6, for example. The image forming unit 5 has a sheet storing part 8 configured to store a sheet, four image forming parts 10 configured to transfer a toner image on the sheet fed from the sheet storing part 8, a fixing device 11 configured to fix the toner image on the sheet and a sheet ejecting part 12 to which the sheet with the fixed toner image is ejected. The sheet includes a sheet-like recording material, such as a resin film and OHP sheet, in addition to a paper sheet.

Above the sheet storing part 8, an exposing device 13 composing of a laser scanning unit (LSU) is arranged. Above the exposing device 13, an intermediate transferring belt 14 as an image carrier is bridged between a plurality of rollers. Above the intermediate transferring belt 14, toner containers 16 corresponding to each color are provided. Along the lower side of the intermediate transferring belt 14, four image forming units 10 corresponding to each color of the toner are arranged.

Each of the image forming unit 10 has a photosensitive drum 16 provided rotatably and a charger 17, a development unit 18, a first transferring part 19, a cleaning device 20 and a static eliminator 21 which are arranged around the photosensitive drum 16 in order of a first transferring process.

In the housing 4, a sheet conveying path 9 configured to convey the sheet in a vertical posture from the sheet storing part 8 toward the sheet ejecting part 12 is provided along the left side face. At an upstream portion of the conveying path 9, a sheet feeding part 22 configured to feed the sheet from the sheet storing part 8 or the like is provided. At a midstream portion of the conveying path 9, a second transferring part 22 is provided at the end of the intermediate transferring belt 14. At a downstream portion from the second transferring part 22 of the conveying path 9, a fixing device 11 having a heating roller and a pressing roller is provided.

At the downstream side end of the sheet conveying path 9, a conveying direction switching part 26 configured to switch the sheet conveying direction into a first discharge part 24 and a second discharge part 25 is provided. The sheet discharged outside the housing 4 from the first discharge part 24 is stacked on the sheet ejecting part 12. On the other hand, the sheet discharged outside the housing 4 from the second discharge part 25 is conveyed into the sheet processing apparatus 3.

The image reading unit 6 and the automatically document feeding device 7 have a same configuration as those of conventional ones and the descriptions are omitted.

Next, the operation of forming an image by the image forming apparatus 1 will be described. When image date is inputted from the computer connected to the image forming apparatus 1 or the image reading device 6 (a print start is instructed), first, a surface of the photosensitive drum 16 electrically charged by the charger 17 is exposed in accordance to the image data by the exposing device 13. An electrostatic latent image formed on the surface of the photosensitive drum 16 by the exposing is then developed into a toner image of corresponding color by the development unit 18. The toner image is first-transferred to a surface of the intermediate transferring belt 14 at the first transferring part 19. The above process is carried out every image forming part 10 to form a full color toner image on the intermediate transferring belt 14. The toner and charge remained on each of the photosensitive drum 16 are removed by the cleaning device 20 and the eliminator 21 respectively.

On the other hand, the sheet fed from the sheet feeding storing part 8 or the like by the sheet feeding part is conveyed to the second transferring part 23 synchronously with the above-mentioned image forming process, and the full color toner image on the intermediate transferring belt 14 is second-transferred on the sheet at the second transferring part 23. The sheet is conveyed along the conveying path 9 to the fixing device 11. The sheet with the fixed toner image is conveyed to the first discharge part 24 or the second discharge part 25 and then to the sheet ejecting part 12 or the sheet processing apparatus 3, respectively.

Next, the sheet processing apparatus 3 will be described. The sheet processing apparatus 3 is configured to apply a stapling process or the like on the sheet discharged from the second sheet discharging part 25 of the image forming apparatus 1.

The sheet processing apparatus 3 includes a housing 31 formed into substantially a box shape and a leg part 32 supporting the housing 31. The housing 31 is formed with a carrying-in part 33 on a side face on the image forming apparatus 1 side such that the sheet discharged from the second sheet discharging part 25 of the image forming apparatus 1 is carried in and with a stacking tray 34 on an opposite side face. In the housing 31, a conveying path 35 along which the sheet is conveyed from the conveying-in part 33 to the stacking tray 34 is formed. On the downstream side of the conveying path 35, a stapling unit 40 configured to staple a bundle of a plurality of sheets is provided. It is noted that it is also possible to provide a punching unit applying a predetermined punching process on the sheet on the upstream side from the stapling unit 40.

Figure 2:
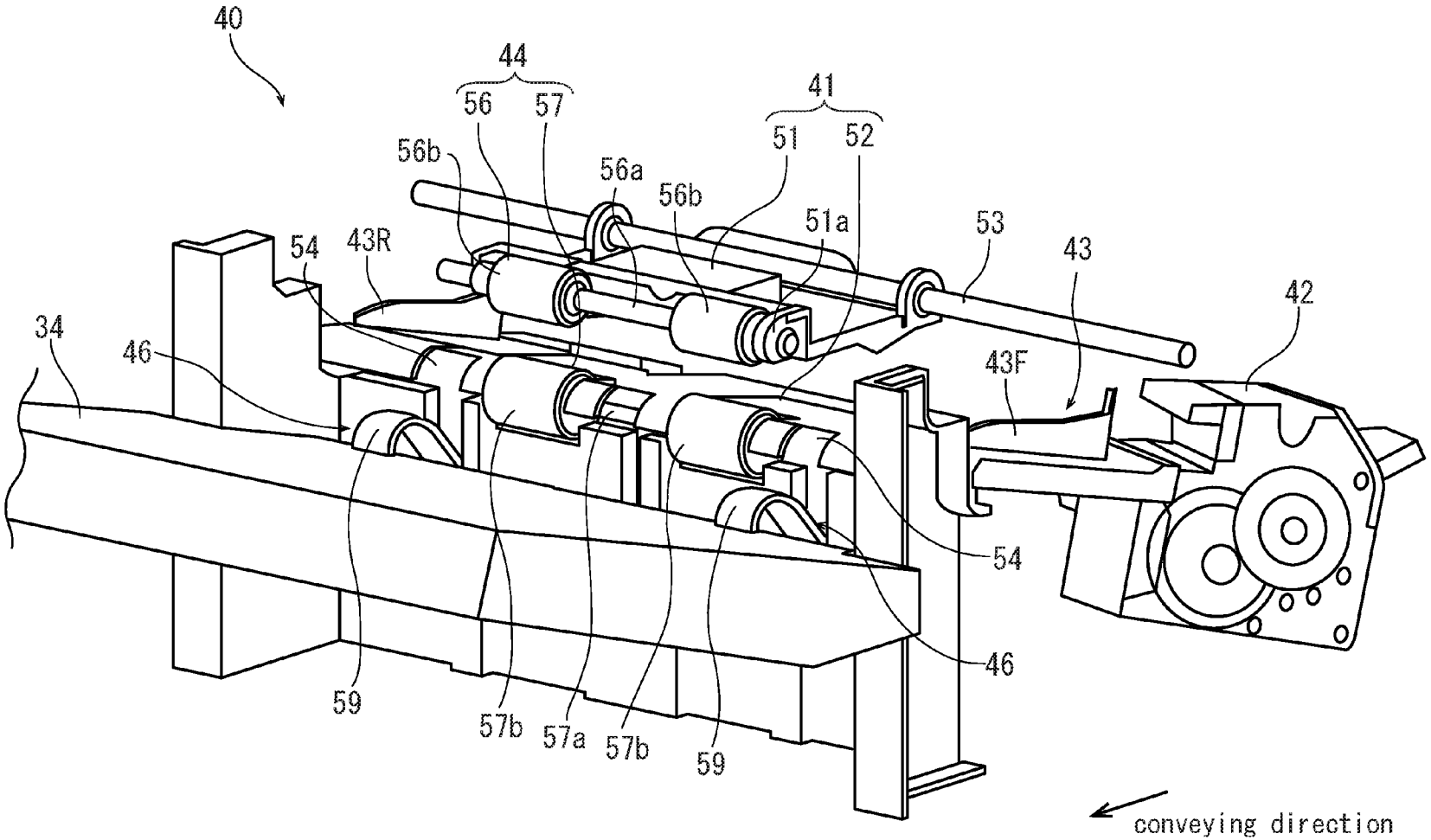
FIG. 2 is a perspective view showing a state in which a pressing lever is turned into a first position, in the sheet processing apparatus of one embodiment of the present invention.
Figure 3:
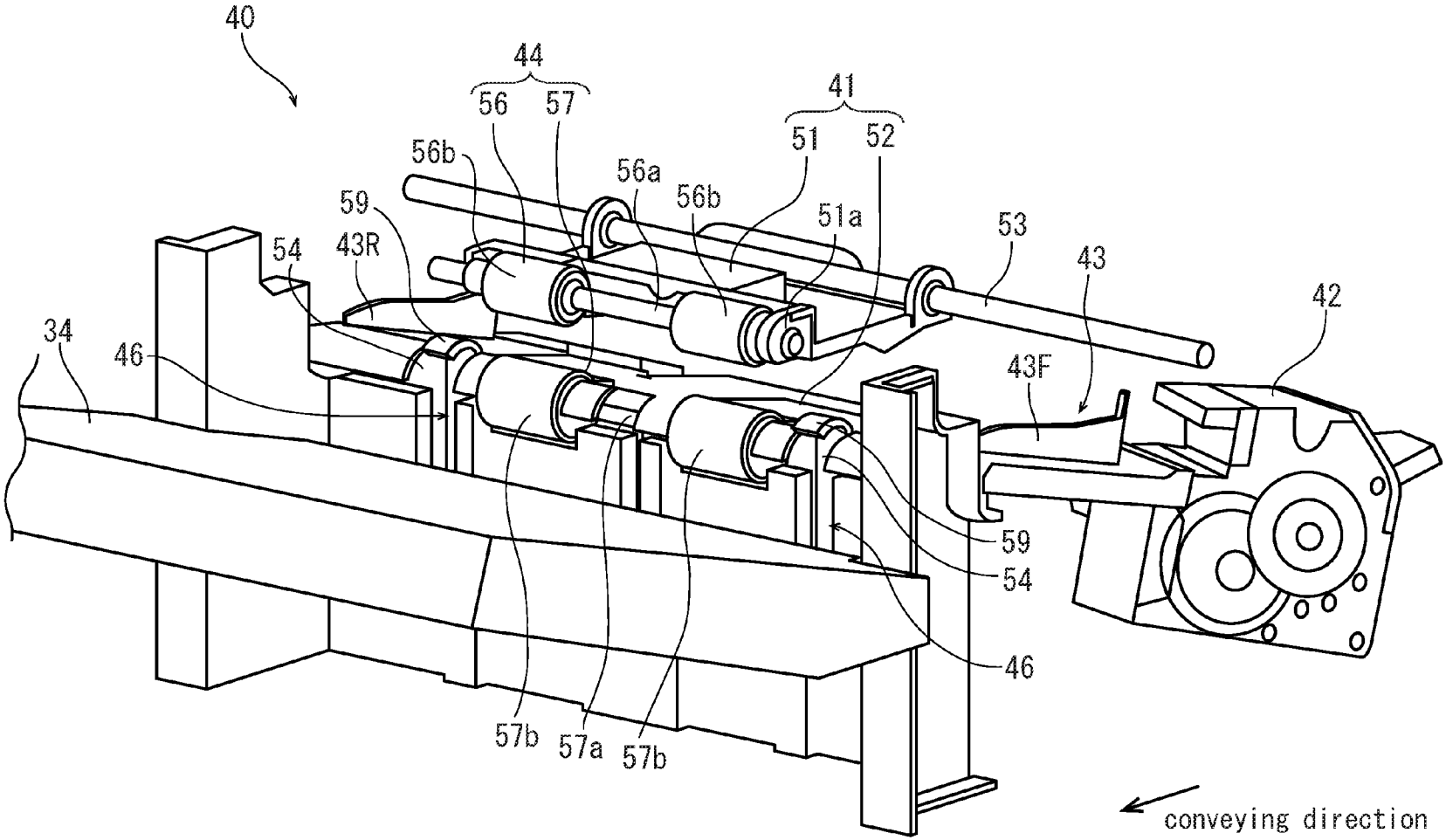
FIG. 3 is a side view showing a state in which the pressing lever is turned into a second position, in the sheet processing apparatus of one embodiment of the present invention.

Next, the stapling unit 40 will be described with reference to FIGS. 2 through 4. FIG. 2 is a perspective view showing the stapling unit in a state in which a pressing lever is turned into a first position, FIG. 3 is a perspective view showing the stapling unit in a state in which the pressing lever is turned into a second position, and FIG. 4 is a front view showing the stapling unit in the state in which the pressing lever is turned into the first position.

The stapling unit 40 includes a processing tray 41 loading a plurality of sheets conveyed from the image forming apparatus 1 into a sheet bundle, a stapler 42 performing a stapling processing, a shifting unit 43 configured to shift the sheet bundle on the processing tray 41, and a discharge part 44 configured to discharge the stapled sheet bundle from the processing tray 41. The sheet bundle discharged from the discharge part 44 is stacked on the stacking tray 34. The stapling unit 40 also includes a pressing lever 46 configured to press the upstream side end in the conveying direction of the sheet bundle discharged on the stacking tray 34.

Figure 4:
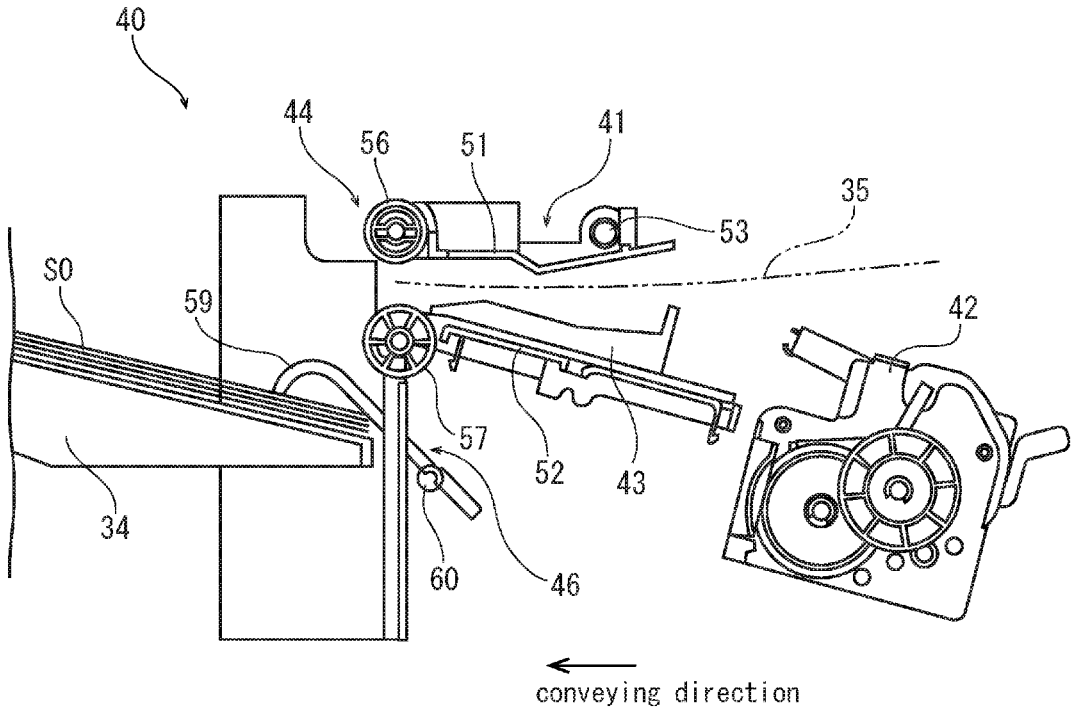
FIG. 4 is a front view showing the state in which the pressing lever is turned into the first position, in the sheet processing apparatus of one embodiment of the present invention.

The processing tray 41 has a pair of upper guide plate 51 and lower guide plate 52 which face with each other across the conveying path 35 (refer to FIG. 4).

The upper guide plate 51 is a rectangular member which is long in a width direction orthogonal to the conveying direction and is short in the conveying direction. The upper guide plate 51 is formed with a pair of front and rear bearing parts 51*a* each having a shaft hole penetrating in the width direction at the downstream side end portion in the conveying direction. The upstream side end portion in the conveying direction of the upper guide plate 51 is turnably supported by a turning shaft 53 extending in the width direction such that the upper guide plate 51 swings around the turning shaft 53 between a substantially horizontal retreating position and a discharging position inclined downward to the downstream side in the conveying direction from the turning shaft 53.

The lower guide plate 52 is a rectangular member which is long in the width direction and is short in the conveying direction, and is formed with rectangular notches 54 at front and rear end portions of the downstream side edge in the conveying direction. The lower guide plate 52 is disposed inclined upward from the upstream side to the downstream side in the conveying direction.

The stapler 42 is disposed at a processing position separated away forward in the width direction from the conveying path 35 on the upstream side in the conveying direction from the processing tray 41. Because the stapler 42 has the same configuration as a conventional one having a stapling function, its description will be omitted here.

The shifting unit 43 has a pair of front cursor 43F and rear cursor 43R that abut respectively with side edges of a sheet and is movable in the width direction on an upper surface of the lower guide plate 52 of the processing tray 41. Specifically, the front and rear cursors 43F and 43R are configured to move in opposite directions in the width direction by a same distance so as to align the sheet in the width direction. Still further, the front and rear cursors 43F and 43R are configured to move together in a same width direction so as to be able to be shifted between a reference position positioned on the conveying path and a processing position separated forward in the width direction from the reference position. Still further, they are configured to be able to be shifted rearward in the width direction from the reference position.

The discharge part 44 has a pair of upper and lower rollers 56 and 57. The upper roller 56 has two roller bodies 56*b* provided around a rotating shaft 56*a* at predetermined intervals. The rotating shaft 56*a* is rotatably supported by the bearing part 51*a* of the upper guide plate 51 of the processing tray 41. The lower roller 57 has two roller bodies 57*b* provided around a rotating shaft 57*a* at predetermined intervals. The two roller bodies 57*b* are respectively disposed in the notch 54 of the lower guide plate 52 of the processing tray 41. The positions of the two roller bodies 57*b* correspond respectively with the positions of the two roller bodies 56*b* of the upper roller 56. The roller bodies 57*b* of the lower roller 57 are made of rubber, for example. The rotating shaft 57*a* of the lower roller 57 is supported rotatably by a driving source (not shown).

When the upper guide plate 51 swings into the retreating position, the upper roller 56 separates from the lower roller 57 to form the conveying path 35 with a predetermined distance between the lower roller 57 and the upper roller 56. When the upper guide plate 51 swings into the discharging position, the upper roller 56 approaches to the lower roller 57. Then, under a state where the upper roller 56 and the lower roller 57 approach with each other, on driving the rotating shaft 57*a* of the lower roller 57, the sheet bundle on the conveying path 35 is conveyed in the conveying direction by the roller bodies 56*b* and 57*b* of the upper and lower rollers 56 and 57.

The stacking tray 34 is disposed on the downstream side in the conveying direction from the discharge part 44 and below the discharge part 44, and is inclined upward from the upstream side to the downstream side in the conveying direction.

The pressing lever 46 has an edge part 59 formed by bending an edge of a lengthy plate piece into an arcuate shape. The pressing levers 46 are respectively disposed on outsides in the front and rear directions of the lower roller 57 of the discharge part 44. The pressing lever 46 is supported turnably by a turning shaft 60 (refer to FIG. 4) extending in the width direction at a position slightly close to the center from the proximal end with the edge part 59 facing the downstream side in the conveying direction. The turning shaft 60 is supported on the upstream side in the conveying direction from the lower roller 57 and below the discharging part 44. The pressing lever 46 turns around the turning shaft 60 between a first position (refer to FIGS. 2 and 4) where the pressing lever 46 is inclined such that the edge part 59 abuts with an upper surface of the stacking tray 34 and a second position (refer to FIG. 3) where the pressing lever 46 erects substantially vertically. At the second position, the pressing lever 46 enters the notch 54 of the lower guide plate 52, and the edge part 59 projects upward above an apex portion of the roller body 57*b* of the lower roller 57. Specifically, the edge part 59 is positioned around an outside of a substantially upper half of the roller body 57*b*, and a distance between the apex portion of the edge part 59 and the apex portion of the roller body 57*b* is 1 mm to 2 mm.

Figure 5:
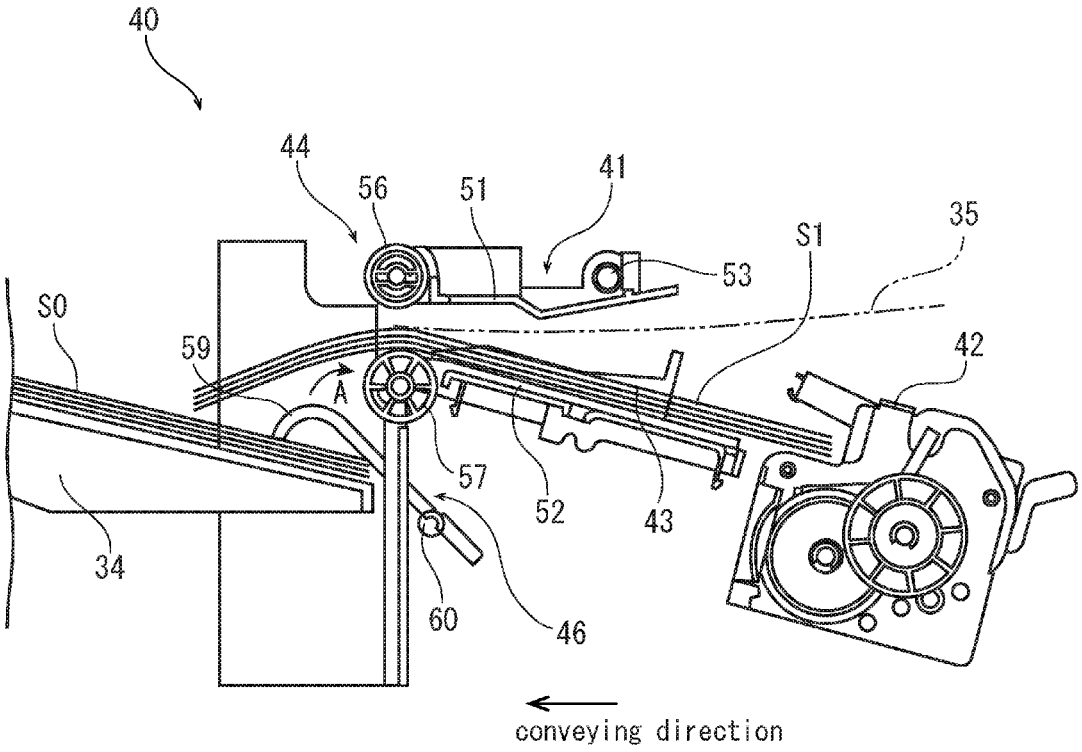
FIG. 5 is a front view showing a sheet conveying state in the sheet processing apparatus of one embodiment of the present invention.
Figure 6:
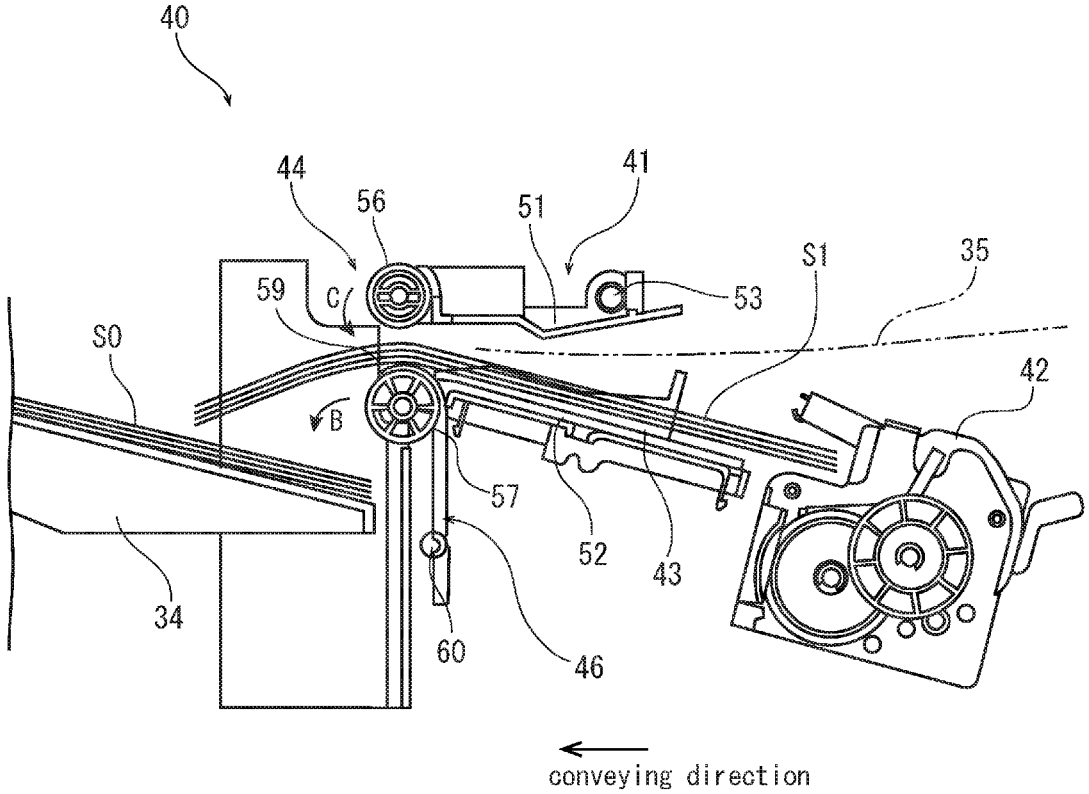
FIG. 6 is a front view showing a sheet bundle shifting state in the sheet processing apparatus of one embodiment of the present invention.
Figure 7:
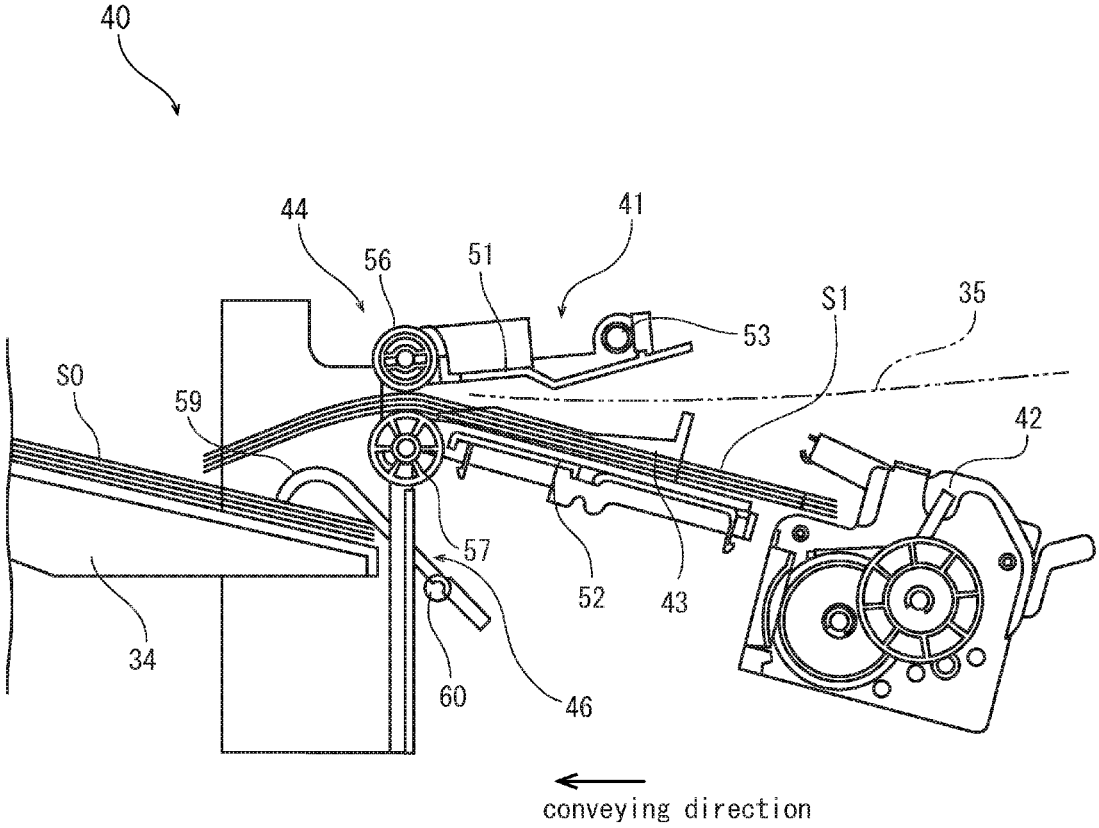
FIG. 7 is a front view showing the sheet bundle discharge state, in the sheet processing apparatus of one embodiment of the present invention.

The stapling process of the stapling unit constructed as described above will be described with reference to FIGS. 4 through 7. FIGS. 4 through 7 are front views showing the stapling process, wherein FIG. 5 shows the sheet stacking process, FIG. 6 shows the shifting process, and FIG. 7 shows the discharging process.

In a standby state, the cursors 43 move into the reference position, and as shown in FIG. 4, the upper guide plate 51 of the processing tray 41 swings into the retreating position. Thereby, the conveying path 35 is formed between the upper and lower rollers 56 and 57 of the discharge part 44. Still further, the pressing lever 46 turns into the first position to press the upstream side end portion of the sheet bundle S0, processed in the previous processing, with the edge part 59.

When a sheet is conveyed from the image forming apparatus 1 in this state, as shown in FIG. 5, the sheet is conveyed until the downstream side end portion in the conveying direction of the sheet passes through between the upper and lower rollers 56 and 57 of the discharge part 44 and the leading edge of the sheet abuts with the sheet bundle S0 on the stacking tray 34. Then, the upstream side portion in the conveying direction of the sheet is held by the lower guide plate 52 of the processing tray 41. At this time, a center portion of an under surface of the sheet comes into contact with the roller bodies 57*b* of the lower roller 57 of the discharge part 44. It is noted that the contact portion of the sheet with the roller bodies 57*b* of the lower roller 57 is different depending on size of the sheet.

The conveyed sheet is then aligned in the width direction one by one by the cursors 43 on the lower guide plate 52 of the processing tray 41. By aligning a predetermined number of conveyed sheets in the above mentioned manner, a sheet bundle S1 of loaded sheets is formed on the lower guide plate 52 of the processing tray 41. After that, the pressing lever 46 is turned into the second position, as indicated by an arrow A in FIG. 5. Thereby, the sheet bundle S1 on the processing tray 41 is lifted up by 1 mm to 2 mm from the lower roller 57 by the edge part 59 of the pressing lever 46, as shown in FIG. 6.

Then, the sheet bundle S1 is shifted to the processing position by the cursors 43 while being lifted up. Because the undermost sheet of the sheet bundle S1 is separated from the lower roller 57 during this shifting, the alignment of the sheet bundle S1 is kept by the cursor 43. It is noted that because the sheet bundle S1 is being lifted up from the lower roller 57 at the peripheral portion around the lower roller 57, most portion on the upstream side in the conveying direction of the sheet bundle S1 shifts along the upper surface of the lower guide plate 52.

When the sheet bundle is shifted into the processing position, the stapler 42 staples an end edge of the sheet bundle S1. After finishing this stapling process, the sheet bundle S1 is shifted into the reference position by the cursors 43. During this shifting, the pressing lever 46 is kept turning into the second position. It is noted that while the pressing lever 46 is separated from the sheet bundle S0 on the stacking tray 34 during this shifting, no problem occurs because the conveying of the sheet is stopped.

At a timing when the sheet bundle S1 returns to the reference position, the pressing lever 46 is turned into the first position, as shown by an arrow B in FIG. 6, and the upper guide plate 51 of the processing tray 41 is swung into the discharging position, as shown by an arrow C in FIG. 6. Then, the edge part 59 of the pressing lever 46 abuts with and then presses the upstream side end portion of the sheet bundle S0 processed in the previous process, as shown in FIG. 7. In the discharging part 44, the upper and lower rollers 56 and 57 approach with each other. On rotating the rotating shaft 57*a* of the lower roller 57 in this state, the processed sheet bundle S1 is discharged onto the stacking tray 34 by the discharge part 44. Because the sheet bundle S0 on the stacking tray 34 is pressed by the pressing lever 46 during this discharging, no such situation that the sheet bundle S0 is pushed by the sheet bundle S1 discharged afterward occurs.

It is noted that the pressing lever 46 turns into the second position just before the processed sheet bundle S1 is discharged onto the stacking tray 34. That is, a sheet detecting sensor (not shown) is attached to the lower guide plate 52 of the processing tray 41 on the upstream side from the discharge part 44. When the sensor detects a rear end of the sheet bundle S1 discharged from the processing tray 41 by the discharge part 44, the pressing lever 46 is turned into the second position after an elapse of a predetermined time (time until the rear end of the sheet bundle S1 leaves from the discharge part 44) from the detection. This makes it possible to prevent the rear end of the sheet bundle S1 from riding over the pressing lever 46.

As described above, according to the sheet processing apparatus 3 of one embodiment of the present invention, it is possible to shift the sheet bundle S1 by the cursors 43 while keeping the alignment because the lower surface of the undermost sheet of the sheet bundle S1 is isolated by the pressing lever 46 so as not to come into contact with the lower roller 57 during the shifting of the sheet bundle S1 on the processing tray 41. It is noted that since a lifting height of the sheet bundle S1 from the lower roller 57 is 1 mm to 2 mm and the most portion on the upstream side in the conveying direction of the sheet bundle S1 is shifted along the upper surface of the lower guide plate 52, the sheet bundle S will not separate from the cursors 43 in the aligning of the sheet bundle S1 or the shifting of the sheet bundle S1 into the processing position.

Still further, the pressing lever 46 turns into the first position in the discharging of the sheet bundle S1 after the stapling process. That is, because the pressing lever 46 is separated from the lower roller 57 of the discharge part 44, the approach of the upper and lower rollers 56 and 57 is not interfered and therefore the sheet bundle S1 can be discharged smoothly by the discharge part 44. Because the pressing lever 46 presses the sheet bundle S0 on the stacking tray 34 in the same time, no such situation that the sheet bundle S1 to be discharged disturbs the sheet bundle S0 occurs.

Still further, because the conventionally provided pressing lever 46 is used, it is possible to keep no new component or mechanism to be added and to deal with the inexpensive and relatively simple structure.

In the present embodiment, it is preferable that an outer surface (surface coming into contact with the lower surface of the sheet bundle S1) of the edge part 59 of the pressing lever 46 has a coefficient of friction lower than that of the roller body 57*b* of the lower roller 57. This makes it possible to shift the sheet bundle S1 smoothly along the outer surface of the edge part 59 in the shifting of the sheet bundle S1 on the processing tray 41 (refer to FIG. 6).

Still further, the pressing lever 46 turns into second position from the first position (refer to the arrow A in FIG. 5) in the shifting of the sheet bundle S1 on the processing tray 41. On the other hand, the pressing lever 46 turns into the first position from the second position (from the state shown in FIG. 6 to the state shown in FIG. 7) in the discharging of the sheet bundle S1 from the processing tray 41 to the stacking tray 34 by the discharge part 44. In these turnings, the pressing lever 46 comes into contact with or separates from the undermost sheet of the sheet bundle S1 on the processing tray 41 while sliding in the conveying direction. Then, if the outer surface of the edge part 59 of the pressing lever 46 is formed to have a coefficient of friction lower than that of the roller body 57*b* of the lower roller 57, it is possible to reduce a friction between the undermost sheet and the pressing lever 46 and therefore to restrict an unnecessary displacement of the undermost sheet.

As a method for forming the outer surface of the edge part 59 of the pressing lever 46 to have a coefficient of friction lower than that of the roller body 57*b* of the lower roller 57, it is possible to provide a rib or a projection on the outer surface or to use a spherical roller in order to reduce a contact area with the sheet. Alternatively, it is possible to coat the outer surface of the edge part 59 with a material having a low coefficient of friction.

Still further, according to the present embodiment, while the pressing lever 46 is formed into the shape having the arcuate edge, it is also possible to form the pressing lever 46 into another shape. A modified example of the pressing lever will be described with reference to FIG. 8.

The pressing lever 46 includes a base part 71 extending straightly upward from the turning shaft 60 and an edge part 72 formed into a substantially flat semi-circular shape, in the front view. More specifically, the edge part has a bent part 72*a* bent in the upstream side substantially at a right angle from a tip end of the base part 71 and a curved part 72*b* curved in the downstream side over the base part 71 from a tip end of the bent part 72*a* into a flat arcuate shape. The turning shaft 60 is supported on the downstream side in the conveying direction from the lower roller 57 below the discharge part 44. It is noted that it is not always necessary to dispose the turning shaft 60 on the downstream side from the lower roller 57 and it may be disposed on the upstream side from the lower roller 57 as long as the turning shaft 60 does not interfere with the rotating shaft 57*a* of the lower roller 57 when the pressing lever 46 is turned into the second position. It is also noted that in the case where the turning shaft 60 is disposed on the upstream side from the lower roller 57, the base part 71 of the pressing lever 46 is formed into a shape extending obliquely upward in the downstream direction at the second position or a shape provided with a bent part to avoid an interfere with the rotating shaft 57*a* of the lower roller 57.

Figure 8:
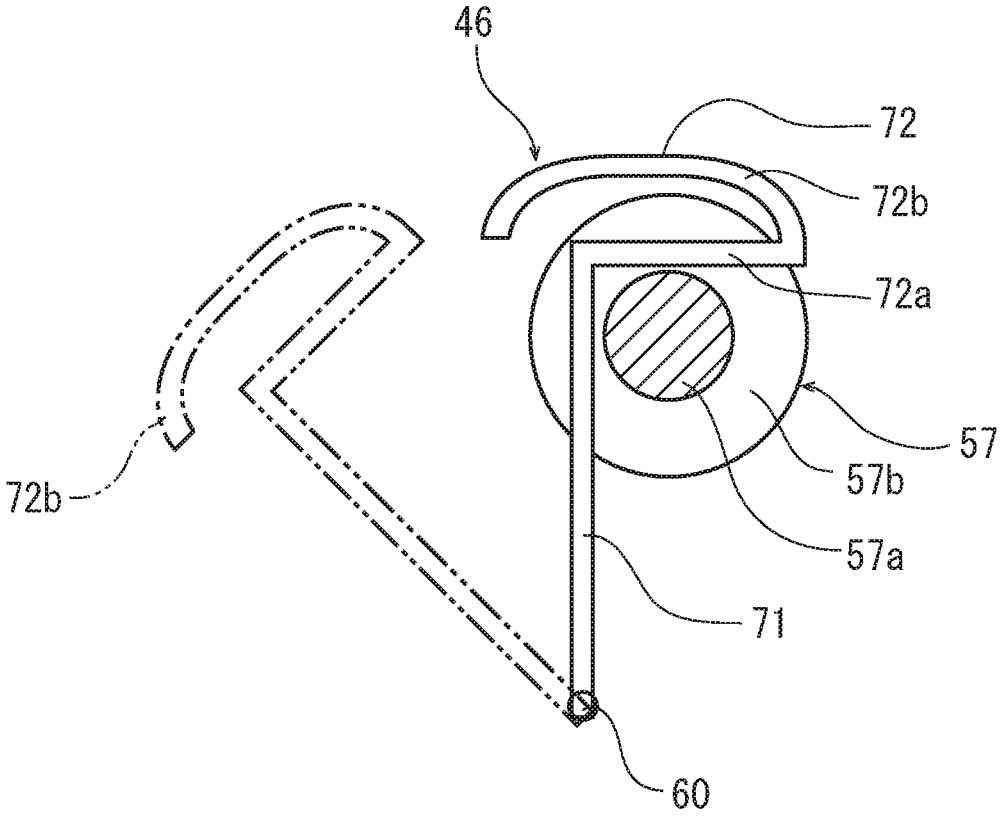
FIG. 8 illustrates a modified example of the pressing lever, in the sheet processing apparatus of one embodiment of the present invention.

By forming the pressing lever 46 into such shapes, when the pressing lever 46 is turned into the second position, as indicated by a solid line in FIG. 8, the base part 71 erects on the downstream side from the rotating shaft 57*a* of the lower roller 57, the bent part 72*a* is located above the rotating shaft 57*a* and the curved part 72*b* projects above the roller body 57*b* of the lower roller 57. Still further, at the first position shown by a two-dot chain line in FIG. 8, it is possible to press the sheet bundle by the edge of the curved part 72*b* projecting on the downstream side from the base part 71.

That is, in the case where the pressing lever 46 is formed into the shape as shown in FIG. 2 and others, the rotating shaft 57*a* has to a length equal to a distance between the two pressing levers 46 because the pressing levers 46 turn across the rotating shaft 57*a* of the lower roller 57. On the other hand, in the case where the pressing lever 46 is formed into the shape as shown in FIG. 8, the base part 71 turns within a region on the downstream side from the rotating shaft 57*a* and a turning range of the pressing lever 46 does not interfere with the rotating shaft 57*a* so that the rotating shaft 57*a* can be configured to penetrate through in the front and rear directions of the housing 31 of the post-processing apparatus 3. This makes it possible to dispose the driving mechanism of the lower roller 57 on the front or rear side of the housing 31 thereby to simplify the configuration of the post-processing apparatus 3.

While the case of stapling the sheet bundle has been described as the sheet processing in the present embodiment, the invention is also applicable in the sheet bundle sorting process. In this case, the sheet bundle S1 is shifted alternately in the width direction by the cursors 43 and then discharged on the stacking tray 34.

While the preferable embodiment and its modified example of the image forming apparatus of the present invention have been described above and various technically preferable configurations have been illustrated, a technical range of the invention is not to be restricted by the description and illustration of the embodiment. Further, the components in the embodiment of the invention may be suitably replaced with other components, or variously combined with the other components. The claims are not restricted by the description of the embodiment of the invention as mentioned above.

The invention claimed is:

1. A sheet processing apparatus applying a post-processing on a conveyed sheet comprising:

a processing tray on which a plurality of sheet are loaded into a sheet bundle;

a shifting unit configured to shift the sheet bundle in a width direction intersecting with a conveying direction of the sheet on the processing tray;

a discharging part configured to discharge the sheet bundle from the processing tray;

a stacking tray on which the sheet bundle discharged by the discharging part is stacked; and a pressing lever turnable between a first position where the pressing lever abuts with the sheet bundle on the stacking tray and a second position where the pressing lever is displaced on the discharging part side from the first position;

wherein the discharging part includes a lower roller abutting with a lowermost sheet of the sheet bundle and an upper roller configured to separate upward from the lower roller during the shifting and to be displaced in a direction approaching the lower roller during the discharging of the sheet bundle; and the pressing lever is configured to project upward from above an apex portion of the lower roller at the second position and to turn into the second position during the shifting.

2. The sheet processing apparatus according to claim 1, wherein the pressing lever is configured to be turned into the first position in the loading of the sheet onto the processing tray and in the discharging of the sheet bundle.

3. The sheet processing apparatus according to claim 1, wherein the pressing lever is formed such that a coefficient of friction of a portion that comes in contact with the lowermost sheet at the second position is lower than that of the lower roller.

4. The sheet processing apparatus according to claim 1, wherein a portion of the pressing lever projecting above an apex portion of the lower roller is formed into an arcuate shape along an outer circumferential surface of the lower roller.

5. The sheet processing apparatus according to claim 1, wherein a turning shaft of the pressing lever is provided below a rotating shaft of the lower roller and a turning orbit of the pressing lever viewed from an axial direction of the turning shaft does not interfere with the rotating shaft of the lower roller.

6. The sheet processing apparatus according to claim 5, wherein the pressing lever includes a base part extending upward from the turning shaft, a bent part bent on an upstream side in the conveying direction from an tip end of the base part and a curved part curved arcuately on a downstream side in the conveying direction from an tip end of the bent part over the base part, in a front view viewed from the axial direction of the turning shaft.

7. An image forming apparatus provided with the sheet processing apparatus as set forth in claim 1.

* * * * *